US005779381A

United States Patent [19]

Muelver

[11] Patent Number: 5,779,381

[45] Date of Patent: Jul. 14, 1998

[54] LOCKABLE CRAYON HOLDER

[76] Inventor: Vance J. Muelver, W.270 N.3894 Parkside Rd., Pewaukee, Wis. 53072

[21] Appl. No.: 859,433

[22] Filed: May 20, 1997

[51] Int. Cl.[6] ..... B43K 21/08

[52] U.S. Cl. ..... 401/79; 401/73; 401/75

[58] Field of Search ..... 401/68, 73, 75, 401/79

[56] References Cited

U.S. PATENT DOCUMENTS

| | | | |
|---|---|---|---|
| 552,265 | 12/1895 | Smith | 401/79 |
| 900,143 | 10/1908 | Bailey | 401/79 |
| 955,617 | 4/1910 | Tucker | 401/79 |
| 1,260,881 | 3/1918 | Doty | 401/79 |
| 2,980,247 | 4/1961 | Giantomasso | 401/79 |
| 3,176,661 | 4/1965 | Langie | 401/75 X |

*Primary Examiner*—Steven A. Bratlie

[57] ABSTRACT

A lockable crayon holder including a cylindrical body having a tapered open forward end and an open rearward end for receiving a crayon therein. The cylindrical body has a plurality of circumferentially disposed engaging members extending angularly from an interior thereof inwardly of the tapered open forward end for engaging the crayon.

1 Claim, 3 Drawing Sheets

LOCKABLE CRAYON HOLDER

BACKGROUND OF THE INVENTION

1. Field of the Invention

The present invention relates to a lockable crayon holder and more particularly pertains to securing a crayon in a tube to prevent breaking of the crayon and to prevent a child from eating the crayon with a lockable crayon holder.

2. Description of the Prior Art

The use of crayon holders is known in the prior art. More specifically, crayon holders heretofore devised and utilized for the purpose of holding crayons are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,193,927 to Kageyama et al. discloses a mechanical pencil having propelling device for a bar shaped article. U.S. Pat. No. 5,048,989 to Stageman discloses a crayon holder. U.S. Pat. No. 4,468,146 to Tabachnik discloses a crayon holder. U.S. Pat. No. 5,112,151 to Collignon discloses a cover for artist's panel. U.S. Pat. No. 4,573,571 to Leem discloses a pencil case. U.S. Pat. No. Des. 348,080 to Popovits discloses the ornamental design for a crayon holder.

While these devices fulfill their respective, particular objective and requirements, the aforementioned patents do not describe a lockable crayon holder for securing a crayon in a tube to prevent breaking of the crayon and to prevent a child from eating the crayon.

In this respect, the lockable crayon holder according to the present invention substantially departs from the conventional concepts and designs of the prior art, and in doing so provides an apparatus primarily developed for the purpose of securing a crayon in a tube to prevent breaking of the crayon and to prevent a child from eating the crayon.

Therefore, it can be appreciated that there exists a continuing need for new and improved lockable crayon holder which can be used for securing a crayon in a tube to prevent breaking of the crayon and to prevent a child from eating the crayon. In this regard, the present invention substantially fulfills this need.

SUMMARY OF THE INVENTION

In the view of the foregoing disadvantages inherent in the known types of crayon holders now present in the prior art, the present invention provides an improved lockable crayon holder. As such, the general purpose of the present invention, which will be described subsequently in greater detail, is to provide a new and improved lockable crayon holder and method which has all the advantages of the prior art and none of the disadvantages.

To attain this, the present invention essentially comprises a cylindrical body having a tapered open forward end and an open rearward end. The open rearward end has a pair of diametrically opposed slots extending inwardly thereof. Each of the slots is defined by an outer portion parallel with the cylindrical body and an inner portion orthogonally disposed with respect to the outer portion. The cylindrical body has a plurality of circumferentially disposed engaging members extending angularly from an interior thereof inwardly of the tapered open forward end. The cylindrical body is dimensioned for receiving a crayon therein. The device includes a plunger assembly comprised of an elongated threaded rod. The rod has an interior end and an exterior end. The plunger assembly includes a stop plate. The stop plate comprises an inner disk and an outer disk. A threaded aperture extends centrally through the inner disk and the outer disk. The threaded aperture adjustably receives the rod therethrough. The inner disk is positionable within the open rearward end of cylindrical body. The outer disk has a diameter greater than a diameter of the cylindrical body whereby when the inner disk is positioned within the open rearward end, the outer disk is in an abutting relationship with the open rearward end. The inner disk has a pair of diametrically opposed pins extending radially therefrom. The pins are received within the diametrically opposed slots of the cylindrical body. The interior end of the rod has a circular push plate secured thereto. The push plate has a diameter less than an interior diameter of the cylindrical body. The exterior end of the rod has a handle secured thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lockable crayon holder which has all the advantages of the prior art crayon holders and none of the disadvantages.

It is another object of the present invention to provide a new and improved lockable crayon holder which may be easily and efficiently manufactured and marketed.

It is a further object of the present invention to provide a new and improved lockable crayon holder which is of durable and reliable construction.

An even further object of the present invention is to provide a new and improved lockable crayon holder which is susceptible of a low cost of manufacture with regard to both materials and labor, and which accordingly is then susceptible of low prices of sale to the consuming public, thereby making such a lockable crayon holder economically available to the buying public.

Even still another object of the present invention is to provide a new and improved lockable crayon holder for securing a crayon in a tube to prevent breaking of the crayon and to prevent a child from eating the crayon.

Lastly, it is an object of the present invention to provide a new and improved lockable crayon holder including a cylindrical body having a tapered open forward end and an open rearward end for receiving a crayon therein. The cylindrical body has a plurality of circumferentially disposed engaging members extending angularly from an interior thereof inwardly of the tapered open forward end for engaging the crayon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
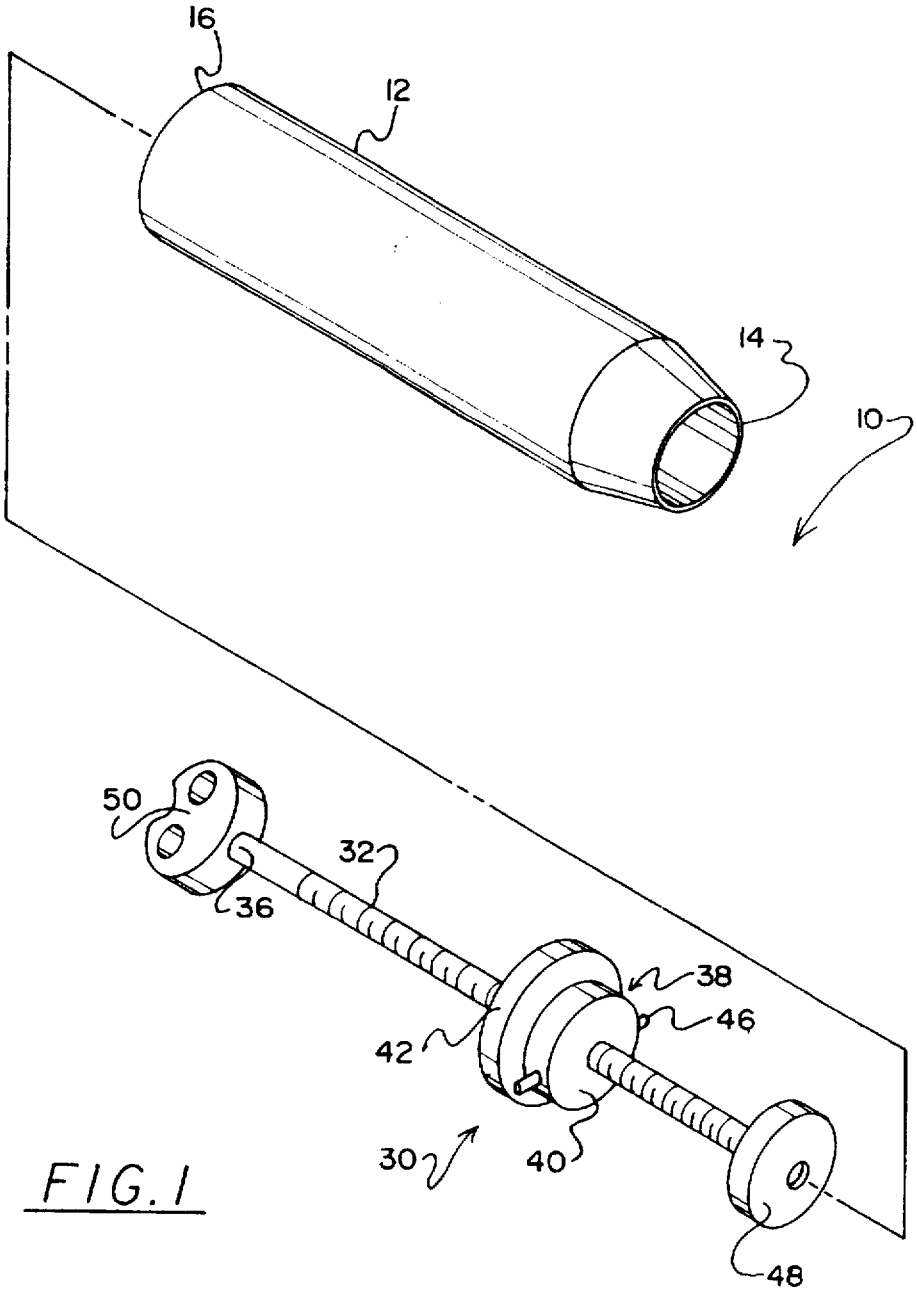
FIG. 1 is a perspective view of the preferred embodiment of the lockable crayon holder constructed in accordance with the principles of the present invention.
Figure 2:
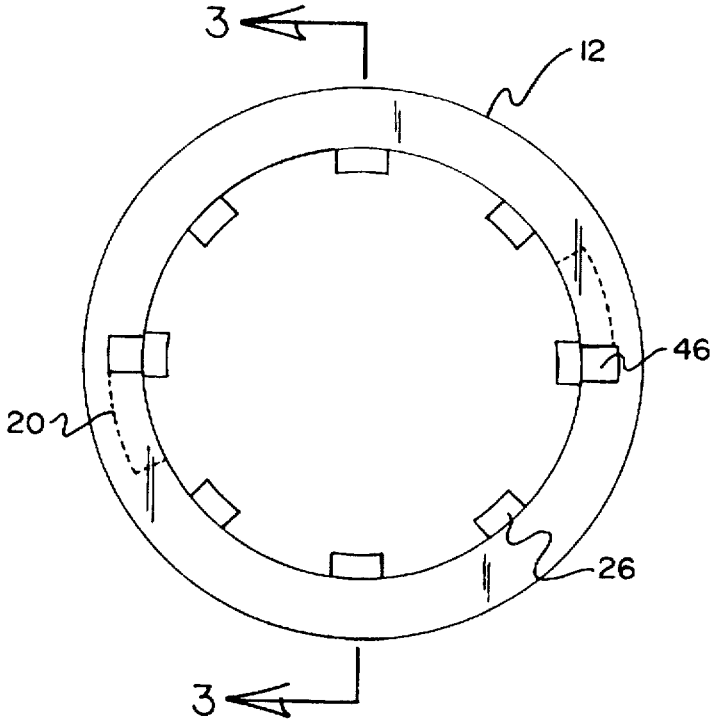
FIG. 2 is a front elevation view of the present invention.
Figure 3:
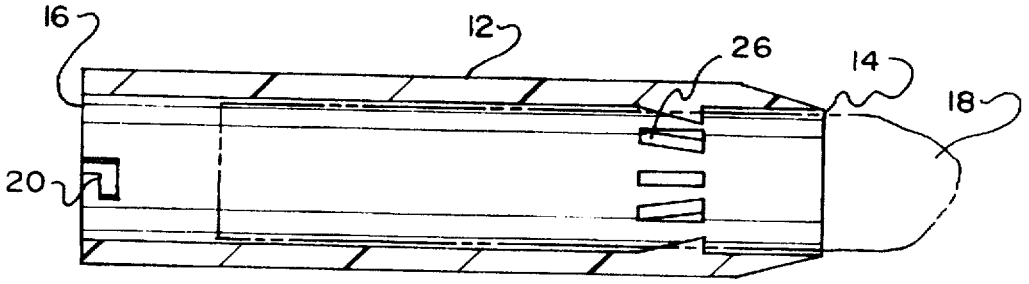
FIG. 3 is a cross-sectional view as taken along line 3—3 of FIG. 2.
Figure 4:
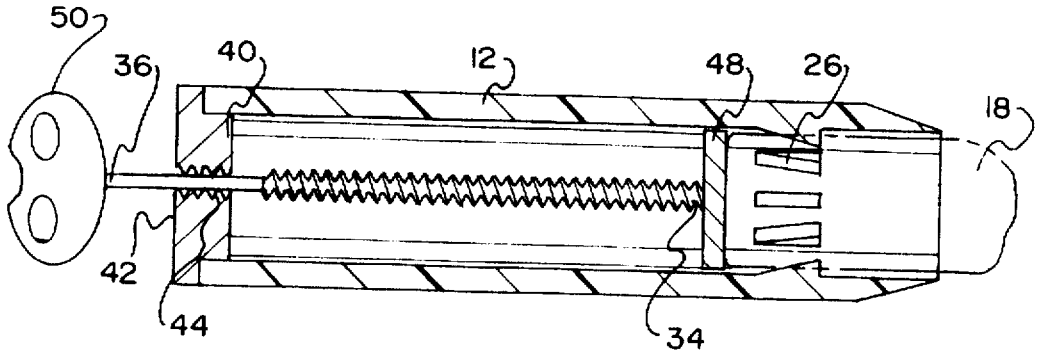
FIG. 4 is a cross-sectional side view of the present invention illustrated with the plunger disposed therein.
Figure 5:
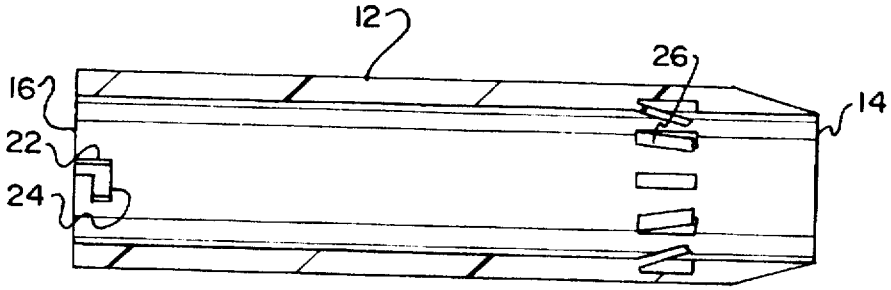
FIG. 5 is a cross-sectional side view of the cylindrical body of the present invention.

With reference now to the drawings, and in particular, to FIGS. 1 through 5 thereof, the preferred embodiment of the new and improved lockable crayon holder embodying the principles and concepts of the present invention and generally designated by the reference number 10 will be described.

Specifically, it will be noted in the various Figures that the device relates to a lockable crayon holder for securing a crayon in a tube to prevent breaking of the crayon and to prevent a child from eating the crayon. In its broadest context, the device consists of a cylindrical body and a plunger assembly. Such components are individually configured and correlated with respect to each other so as to attain the desired objective.

The device 10 includes a cylindrical body 12 having a tapered open forward end 14 and an open rearward end 16. Note FIG. 1. The cylindrical body is dimensioned for receiving a crayon 18 therein with a tip of the crayon extending outwardly of the tapered open forward end. The open rearward end has a pair of diametrically opposed slots 20 extending inwardly thereof. Each of the slots is defined by an outer portion 22 parallel with the cylindrical body and an inner portion 24 orthogonally disposed with respect to the outer portion. The cylindrical body has a plurality of circumferentially disposed engaging members 26 extending angularly from an interior thereof inwardly of the tapered open forward end. The engaging members, as best illustrated in FIGS. 2–5, serve to engage the crayon within the cylindrical body. The angular orientation of the engaging members preclude manual forward movement of the crayon with respect to the cylindrical body by a child thereby preventing the child from placing the crayon or broken piece of the crayon in the child's mouth.

The device includes a plunger assembly 30 comprised of an elongated threaded rod 32. The plunger assembly serves to push the crayon forwardly within the cylindrical body. The rod has an interior end 34 and an exterior end 36. The plunger assembly includes a stop plate 38. The stop plate comprises an inner disk 40 and an outer disk 42. A threaded aperture 44 extends centrally through the inner disk and the outer disk. The threaded aperture adjustably receives the rod therethrough. The inner disk is positionable within the open rearward end of cylindrical body. The outer disk has a diameter greater than a diameter of the cylindrical body whereby when the inner disk is positioned within the open rearward end, the outer disk is in an abutting relationship with the open rearward end. The inner disk has a pair of diametrically opposed pins 46 extending radially therefrom. The pins are received within the diametrically opposed slots of the cylindrical body to lock the stop plate within the cylindrical body whereby the rod can be removed from the device. The interior end of the rod has a circular push plate 48 removably secured thereto. The push plate has a diameter less than an interior diameter of the cylindrical body. The push plate serves to abut the crayon thereby biasing the crayon forwardly within the cylindrical body. The exterior end of the rod has a handle 50 secured thereto. Rotation of the handle allows for the rod to move forward thereby pushing the push plate against the rearward end of the crayon to push the crayon outwardly of the open tapered forward end of the cylindrical body.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A lockable crayon holder for securing a crayon in a tube to prevent breaking of the crayon and to prevent a child from eating the crayon comprising, in combination:

a cylindrical body having a tapered open forward end and an open rearward end, the cylindrical body dimensioned for receiving a crayon therein with a tip of the crayon extending outwardly of the open forward end, the open rearward end having a pair of diametrically opposed slots extending inwardly thereof, each of the slots being defined by an outer portion parallel with the cylindrical body and an inner portion orthogonally disposed with respect to the outer portion, the cylindrical body having a plurality of circumferentially disposed engaging members extending angularly from an interior thereof inwardly of the tapered open forward end for engaging the crayon and abating manual forward movement of the crayon with respect to the cylindrical body by a child; and a plunger assembly comprised of an elongated threaded rod, the rod having an interior end and an exterior end, the plunger assembly including a stop plate, the stop plate comprising an inner disk and an outer disk, a threaded aperture extending centrally through the inner disk and the outer disk, the threaded aperture adjustably receiving the rod therethrough, the inner disk positionable within the open rearward end of cylindrical body, the outer disk having a diameter greater than an interior diameter of the cylindrical body whereby when the inner disk is positioned within the open rearward end, the outer disk is in an abutting relationship with the open rearward end, the inner disk having a pair of diametrically opposed pins extending radially therefrom, the pins received within the diametrically opposed slots of the cylindrical body, the interior end of the rod having a circular push plate secured thereto, the push plate having a diameter less than an interior diameter of the cylindrical body, the exterior end of the rod having a handle secured thereto.

* * * * *